United States Patent [19]

Saito et al.

[11] Patent Number: 4,616,619

[45] Date of Patent: Oct. 14, 1986

[54] METHOD FOR CONTROLLING AIR-FUEL RATIO IN INTERNAL COMBUSTION ENGINE

[75] Inventors: Kimitaka Saito, Okazaki; Tokio Kohama, Nishio; Tsuneyuki Egami, Nukata; Tsutomu Saito, Okazaki; Hiroshi Takahashi, Toyota; Kunihiko Sato, Okazaki, all of Japan

[73] Assignees: Nippon Soken, Inc., Nishio; Toyota Jidosha Kabushiki Kaisha, Toyota, both of Japan

[21] Appl. No.: 630,682

[22] Filed: Jul. 13, 1984

[30] Foreign Application Priority Data

Jul. 18, 1983 [JP] Japan ..... 58-129497
Jul. 21, 1983 [JP] Japan ..... 58-131814

[51] Int. Cl.[4] ..... F02D 41/14

[52] U.S. Cl. ..... 123/489; 123/492; 123/493

[58] Field of Search ..... 123/489, 492, 493, 491

[56] References Cited

U.S. PATENT DOCUMENTS

| | | | |
|---|---|---|---|
| 4,075,982 | 2/1978 | Asano et al. | 123/492 |
| 4,109,615 | 8/1978 | Asano | 123/491 |
| 4,235,204 | 11/1980 | Rice | 123/440 |
| 4,279,503 | 6/1981 | Pomerantz | 123/438 |
| 4,355,616 | 10/1982 | Tamura et al. | 123/489 |
| 4,359,983 | 11/1982 | Carlson | 123/493 |
| 4,416,237 | 11/1983 | Aoki et al. | 123/438 |
| 4,437,446 | 3/1984 | Isomura et al. | 123/492 |
| 4,463,731 | 8/1984 | Matsuoka | 123/492 |
| 4,499,882 | 2/1985 | Saito et al. | 123/489 |
| 4,513,722 | 4/1985 | Hasegawa | 123/492 |

FOREIGN PATENT DOCUMENTS

| | | | |
|---|---|---|---|
| 56-6034 | 1/1981 | Japan . | |
| 57-143136 | 9/1982 | Japan | 123/493 |
| 58-3288 | 1/1983 | Japan | 123/492 |
| 58-133434 | 8/1983 | Japan . | |
| 58-133435 | 8/1983 | Japan . | |

*Primary Examiner*—Andrew M. Dolinar
*Attorney, Agent, or Firm*—Cushman, Darby & Cushman

[57] ABSTRACT

A method for controlling the air-fuel ratio in an internal combustion engine in which the correction value of a transient fuel injection amount is decided, at a predetermined interval, in accordance with the acceleration or deceleration state of the engine, and the amount of fuel injection supplied to the engine is corrected by the decided correction value. In the process of the correction, the deviation of the air-fuel ratio from a reference air-fuel ratio in acceleration or deceleration of the engine is detected, and the correction value of the fuel injection amount correction in the transient state of the engine in accordance with the detected air-fuel ratio deviation is determined. In the correction of amount of fuel injection in the transient state of the engine, the correction value is decided on the basis of a factor for deciding the correction value and the blunted value of the factor for deciding the correction value.

32 Claims, 26 Drawing Figures

| Fig. 3A | Fig. 3B |
|---|---|

| Fig.14A-1 | Fig.14A-2 | Fig.14A-3 |
|---|---|---|

METHOD FOR CONTROLLING AIR-FUEL RATIO IN INTERNAL COMBUSTION ENGINE

BACKGROUND OF THE INVENTION

1. Field of the Invention

The present invention relates to a method for controlling the air-fuel ratio in an internal combustion engine. The method according to the present invention is applicable to an automobile engine.

2. Description of the Prior Art

One known type of apparatus for controlling the air-fuel ratio in an internal combustion engine includes means for generating a fundamental fuel signal representing engine fuel demand in a steady state of the engine in correspondence with values of predetermined engine operation parameters, including engine temperature; means for detecting a transient operation state of the engine representing output power increase demand; means, responsive to the measured engine temperature and the detected transient state of the engine, for generating a reinforce promotion signal which has an initial value determined by the detected transient state of the engine and which is increased by a factor changing toward unity at a rate decided by the measured engine temperature; and means for supplying fuel to the engine in accordance with the fundamental fuel signal and the reinforce promotion signal so as to supply the engine with fuel in accordance with the fuel demand. This type of apparatus enables a fuel supply system with a constantly optimum air-fuel ratio not only in a steady state but also in a transient state of the engine and thus enables constantly optimal engine operation. Such an apparatus is disclosed, for example, in Japanese Unexamined Patent Publication (Kokai) No. 56-6034.

In this type of apparatus, however, no consideration is given to long-term changes in the operating characteristics of the engine, for example, changes in characteristics due to deposition of a viscous material such as fine carbon particles originating from lubricant constituents and combustion products at the valve clearance or at an injection nozzle of an electronic fuel injector and changes in characteristics due to such deposition at the rear surface of a cylinder intake valve.

Clogging of injectors may be compensated for by a feedback operation by an air-fuel ratio sensor in the case of steady-state operation, but this has not been possible in transient-state operation due to the absence of correction means. Also, this type of apparatus does not take into consideration inevitable variations in and aging of the structures of the manufactured engines or airflow meters.

Further, it does not consider the problem of the seasonal difference in specific properties of the gasoline used. Usually, a gasoline producer sells different kinds of gasoline for each season of the year. These, of course, differ in volatility characteristics, as expressed by Reid vapor pressure or distillation characteristics. Even gasolines from the same producer vary from 0.5 kg/cm$^2$ to 0.86 kg/cm$^2$ in vapor pressure or from 40° C. to 58° C. in 10% recovered temperature.

Such differences in volatility characteristics result in considerably different air-fuel characteristics in the transient operation state.

When engine operation characteristics change due to long-term deposits or when low volatility gasoline is used, the air-fuel ratio in the acceleration state becomes relatively lean. Hence, the engine operation deteriorates, e.g., non-smooth acceleration occurs. On the other hand, the air-fuel ratio in the deceleration state becomes relatively rich. Hence, emission and the specific fuel consumption deteriorate. Even when a high volatility gasoline is used, the air-fuel ratio becomes rich in the acceleration state, resulting in the same problems.

A technique for the control of the air-fuel ratio to overcome the above problems has been proposed in Japanese Patent Application No. 58-3288 (corresponding to U.S. Ser. No. 566,815), however, this still requires further improvement.

SUMMARY OF THE INVENTION

It is an object of the present invention to provide an improved method for controlling the air-fuel ratio in an internal combustion engine in which the optimal air-fuel ratio is maintained in the acceleration or deceleration state and, accordingly, optimal engine operation, low emission, and the specific fuel consumption are maintained.

According to an aspect of the present invention, there is provided a method for controlling the air-fuel ratio in an internal combustion engine, by transient fuel amount modification, comprising the steps of: detecting the air-fuel ratio deviation from a reference air-fuel ratio during the transient period of the internal combustion engine; calculating a blunted value of a parameter for deciding the fuel injection amount correction; regulating the correction amount for transient fuel injection amount correction in accordance with the detected air-fuel ratio deviation and the calculated blunted value of the parameter, at a predetermined interval of time; deciding the amount of fuel injection on the basis of the regulated correction amount; and supplying the internal combustion engine with the decided amount of fuel injection.

According to another aspect of the present invention, there is provided a method for controlling the air-fuel ratio in an internal combustion engine, by transient fuel amount increase, comprising the steps of: selecting a reference air-fuel ratio; detecting the air-fuel ratio deviation from the reference air-fuel ratio during the transient period of the internal combustion engine; regulating the correction amount for transient fuel injection amount correction in accordance with the detected air-fuel ratio deviation; deciding the amount of fuel injection on the basis of the regulated correction amount; and supplying the internal combustion engine with the decided amount of fuel injection.

BRIEF DESCRIPTION OF THE DRAWINGS

In the drawings.

FIGS. 9A, 9A-1, 9A-2 and 9A-3 are a detailed flow chart of the calculation of the value corresponding to the amount of the deposit;

FIGS. 14, 14A-1, 14A-2, 14A-3 and 14B are flow charts of the control operation according to another embodiment of the present invention;

DESCRIPTION OF THE PREFERRED EMBODIMENTS

Before describing the embodiments of the present invention, the manner of the change with time of the air-fuel ratio in an internal combustion engine under the influence of deposits will be described below with reference to FIG. 1.

Figure 1:
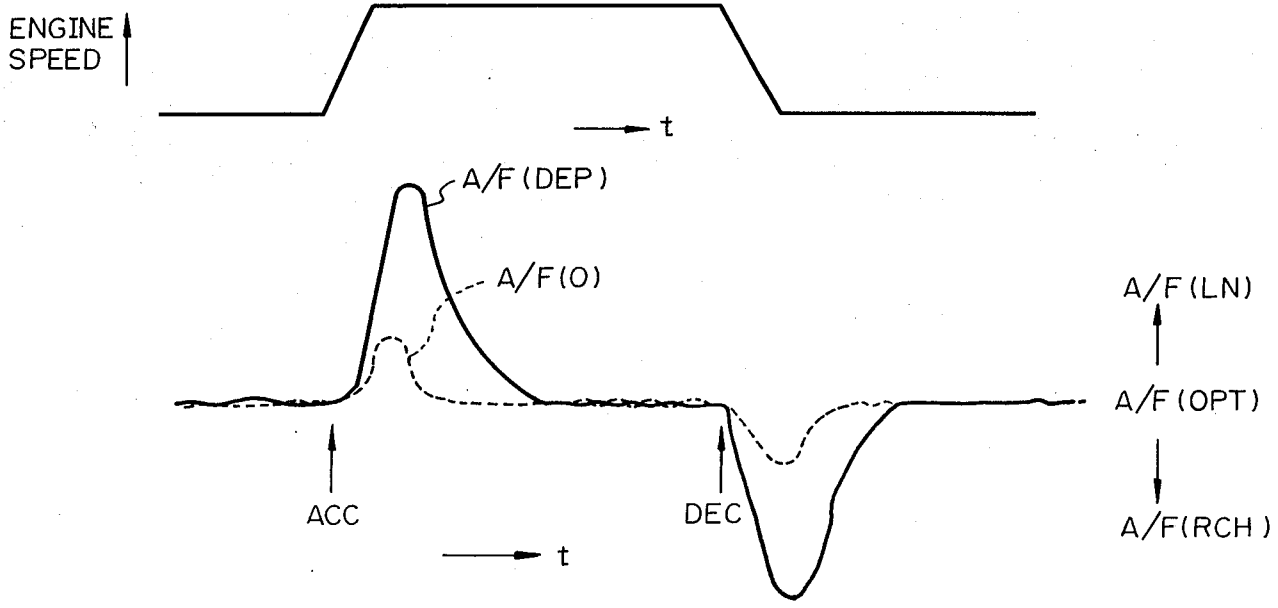
FIG. 1 shows the change with time of the air-fuel ratio in correspondence with engine acceleration and deceleration.

In FIG. 1, the waveform A/F(O) represents the change of the air-fuel ratio without deposits, while the waveform A/F(DEP) represents the change of air-fuel ratio with deposits. Acceleration timing ACC, deceleration timing DEC, optimum air-fuel ratio A/F(OPT), lean-side air-fuel ratio A/F(LN), and rich-side air-fuel ratio A/F(RCH) are indicated in FIG. 1.

Figure 2:
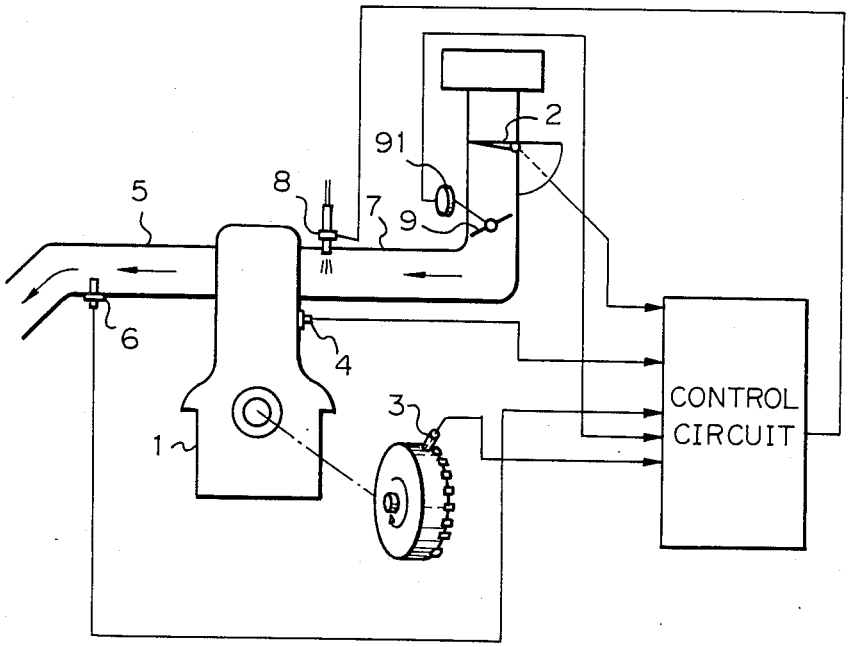
FIG. 2 is a schematic diagram of an apparatus for carrying out the method according to the present invention.

An apparatus for carrying out the method according to the present invention is illustrated in FIG. 2. In the apparatus shown in FIG. 2, there are provided a six-cylinder spark-ignition-type engine 1 with a known electronically controlled fuel injection system, an intake air amount sensor 2, an engine speed sensor 3, a coolant water temperature sensor 4, an exhaust route 5, and an air-fuel ratio sensor 6. There are also provided an air intake pipe 7, a solenoid fuel injection valve 8, a throttle valve 9 for controlling the amount of the intake air, a throttle sensor 91 for detecting the opening degree of the throttle valve 9, and a control circuit CONT for calculating the amount of the fuel to be supplied to the engine 1 and supplying the actuating signal based on the calculated amount to the fuel injection valve 8.

In the steady running state of the engine, the control circuit CONT calculates the fundamental fuel injection amount on the basis of signals from the intake air amount sensor 2, engine speed sensor 3, and coolant water temperature sensor 4; carries out the correction of the feedback correction value calculated on the basis of the signal from the air-fuel ratio sensor 6; and delivers the signal instructing the open period of the fuel injection valve 8.

In the engine acceleration or deceleration state, which is detected by the throttle sensor 91 or the intake air amount sensor 2, the control circuit CONT carries out the correction of the fuel injection amount for the transient running state.

Figures 3, 3A:
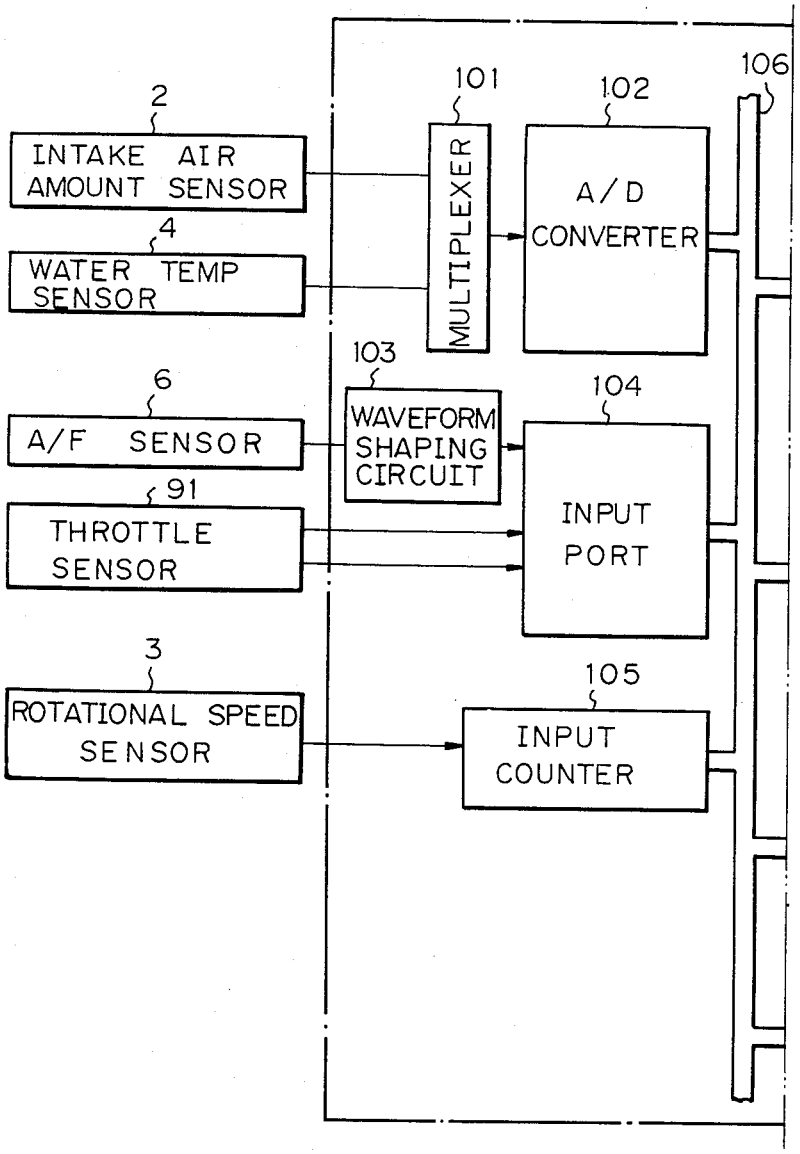
FIGS. 3, 3A and 3B illustrate the structure of the control circuit in the apparatus shown in FIG. 2.
Figure 3B:
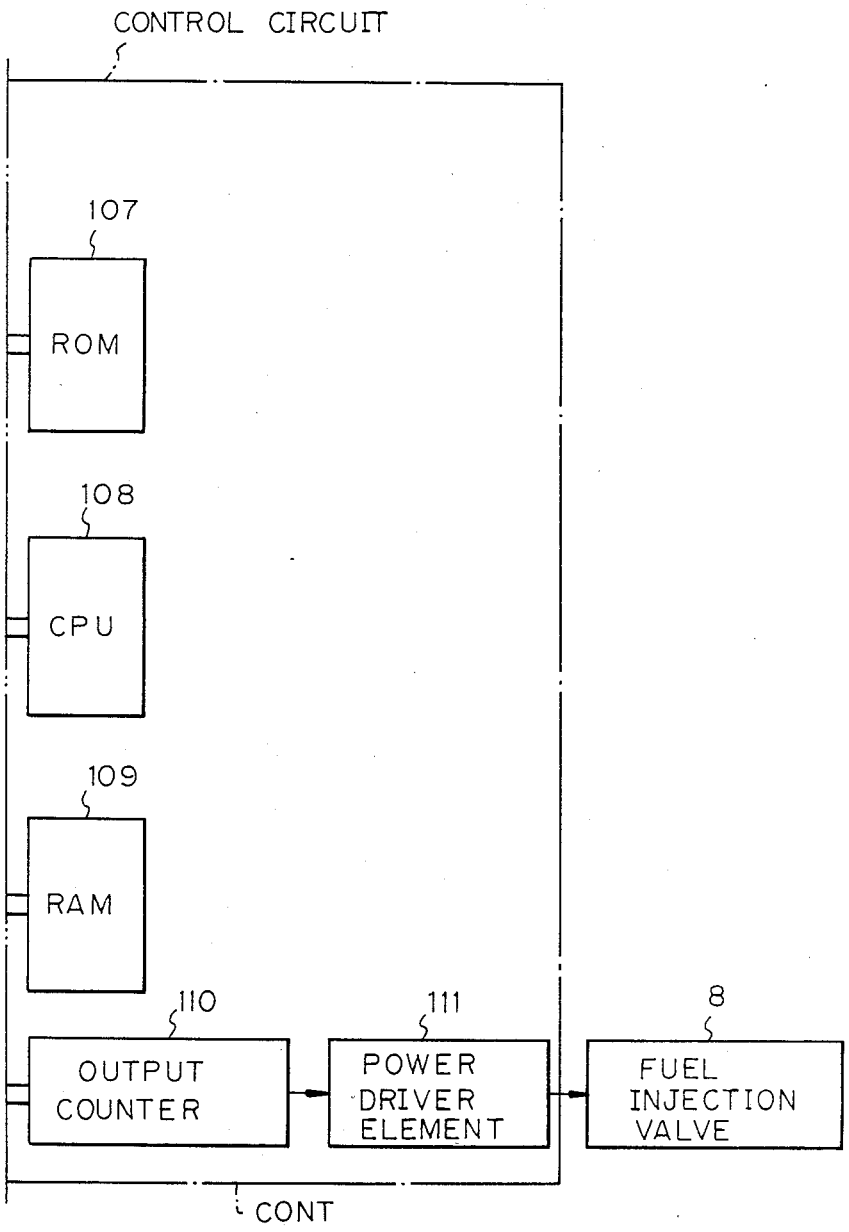

The structure of the control circuit CONT in the apparatus of FIG. 2 is illustrated in FIG. 3. In the control circuit CONT, there is provided a multiplexer 101, an analog-to-digital (A/D) converter 102, a waveform-shaping circuit 103, an input port 104, an input counter 105, a bus 106, a read-only memory (ROM) 107, a central processor unit (CPU) 108, a random-access memory (RAM) 109, an output counter 110, and a power driver element 111.

The multiplexer 101 receives signals from the intake air amount sensor 2 and the coolant water temperature sensor 4. The waveform-shaping circuit 103 receives a signal from the air-fuel ratio sensor 6. The input port 104 receives signals from the waveform-shaping circuit 103 and the throttle sensor 91. The input counter 105 receives a signal from the engine speed sensor 3. The output of the power driver element 111 is supplied to the fuel injection valve 8.

A microcomputer of the type of TOYOTA TCCS can be used for the control cirucit CONT. An air-fuel ratio deviation detection function and a transient fuel amount correction function are additionally provided in the control circuit CONT.

Figure 4:
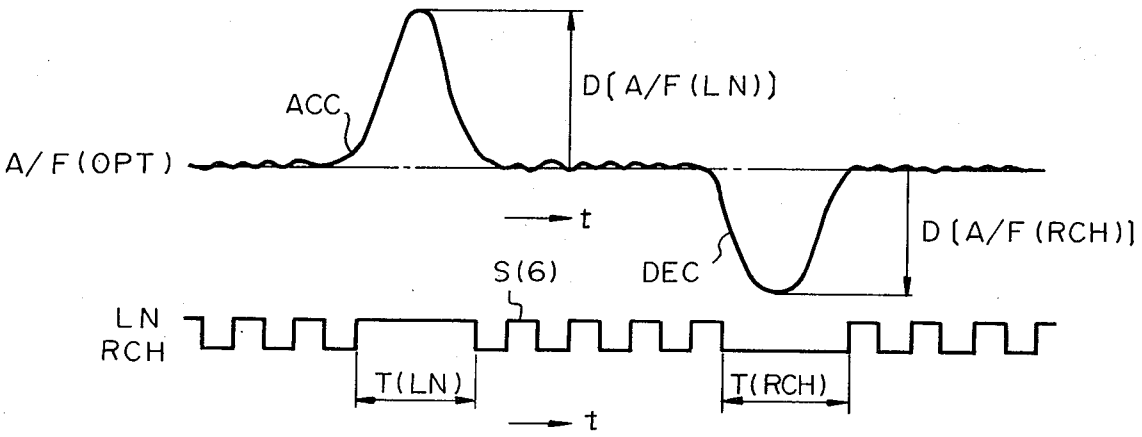
FIGS. 4 and 5 illustrate the relationship between the behavior of the air-fuel ratio in the acceleration or deceleration state and the behavior of the signal from the air-fuel ratio sensor in the acceleration or deceleration state of the engine.
Figure 5:
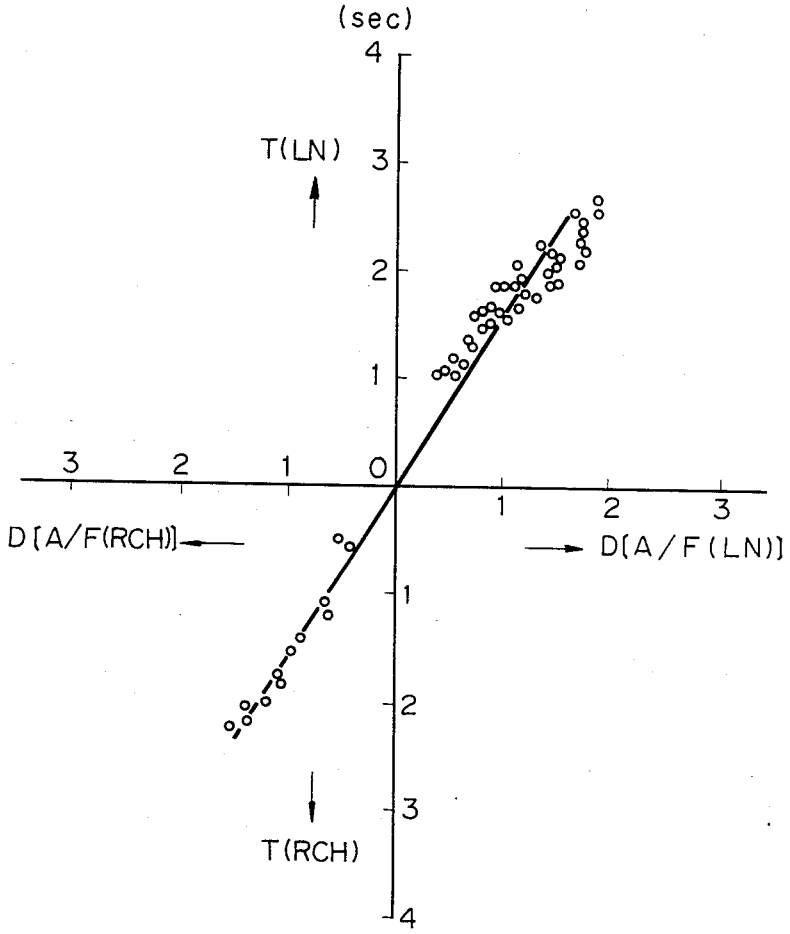

The relationship between the maximum deviations D[A/F(LN)] to the lean side and D[A/F(RCH)] to the rich side from the optimum air-fuel ratio A/F(OPT) in the acceleration or deceleration state and also the time length T(LN) or T(RCH) of detecting the lean (T(LN)) or rich (T(RCH)) state of the mixed gas by the air-fuel ratio in the acceleration or deceleration state are illustrated in FIGS. 4 and 5. In FIG. 4, ACC and DEC represent acceleration and deceleration, respectively, and S(6) represents the signal from the air-fuel ratio sensor 6.

Figure 6:
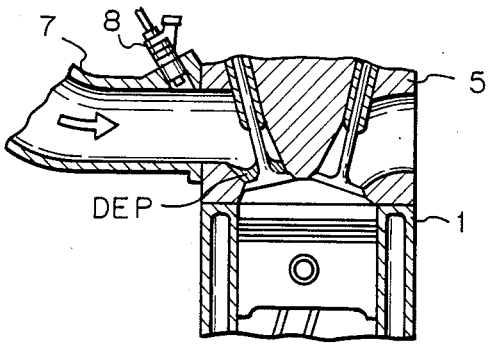
FIGS. 6 and 7 illustrate the existence of deposits in the air-intake route and the relationship between the amount of the deposits and the behavior of the air-fuel ratio in the engine acceleration or deceleration state.
Figure 7:
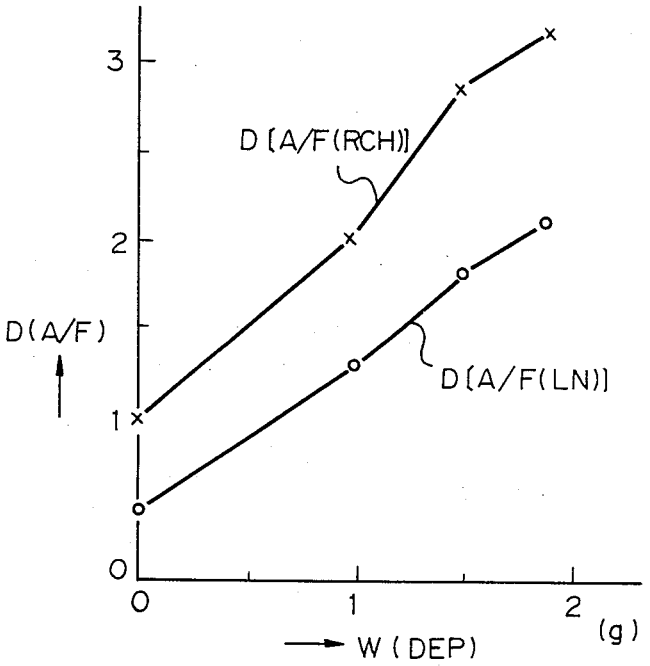

As an example of air-fuel ratio deviation from the optimum air-fuel ratio, the relationships between the amount W(DEP) of deposits in the air intake route and the maximum air-fuel ratio deviations D[A/F (LN)], D[A/F(RCH)] are illustrated in FIGS. 6 and 7.

It will be understood from FIGS. 4 to 7 that the value corresponding to the deposit amount can be detected by measuring the lean-state duration TL in the state of acceleration or the rich-state duration TR in the state of deceleration. The characteristics shown in FIGS. 4 and 7 are obtained by operating an engine of the 5M-G type maunufactured by Toyota Jidosha K. K.

Figure 8:
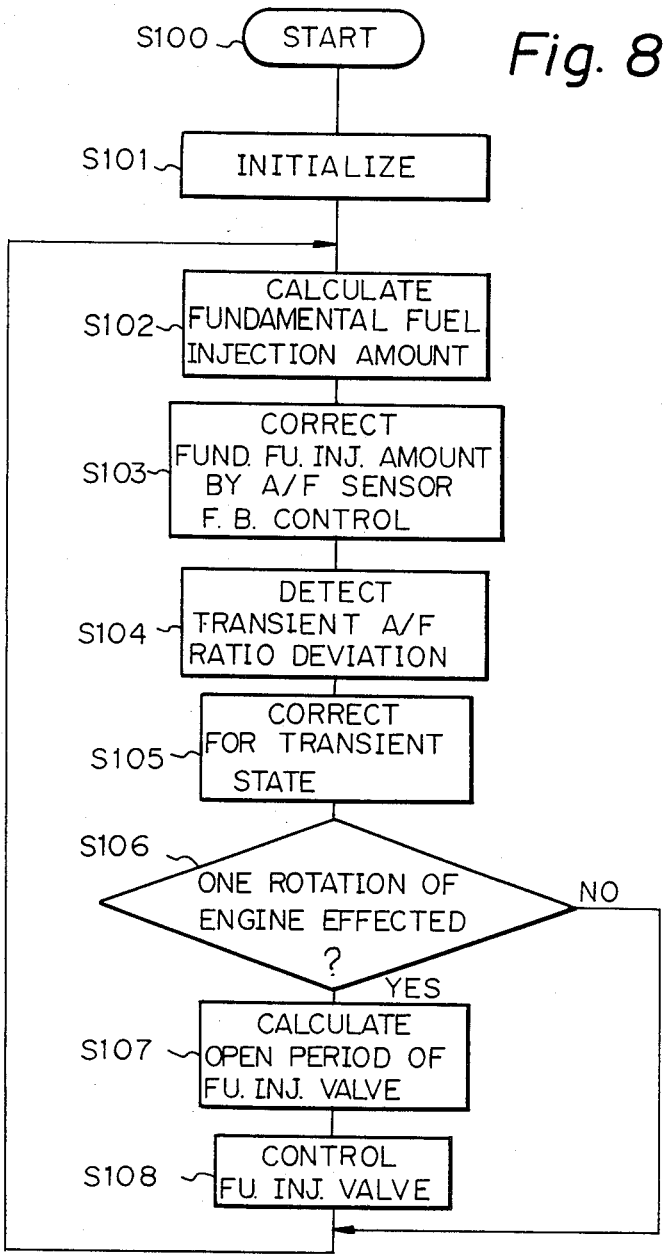
FIG. 8 is a flow chart of the operation of the apparatus shown in FIG. 2.

A flow chart of the program of the control circuit CONT is shown in FIG. 8. This program is for carrying out electronically controlled fuel injection and consists of steps S100 to S108. The process is started in step S100. Initialization of the input port is carried out in step S101. In step S102, a fundamental fuel injection amount is calculated from data Q of the intake air amount, data N of the engine speed, and data $\theta_W$ of the water temperature. In step S103, the fundamental fuel injection amount is corrected by feedback control using the signal from the air-fuel ratio sensor 6 so as to realize a constant air-fuel ratio.

In step S104, the detection of the air-fuel ratio deviation in the acceleration state is carred out. In step S105, the calculation of the transient fuel amount correction ratio is carried out. In step S106, one rotation of the engine is detected, and, in step S107, the open period of the fuel injection valve 8 for one injection is calculated from the fundamental fuel injection amount corrected by feedback control and the transient fuel amount correction ratio per each rotation of the engine.

Figures 1, 9A:
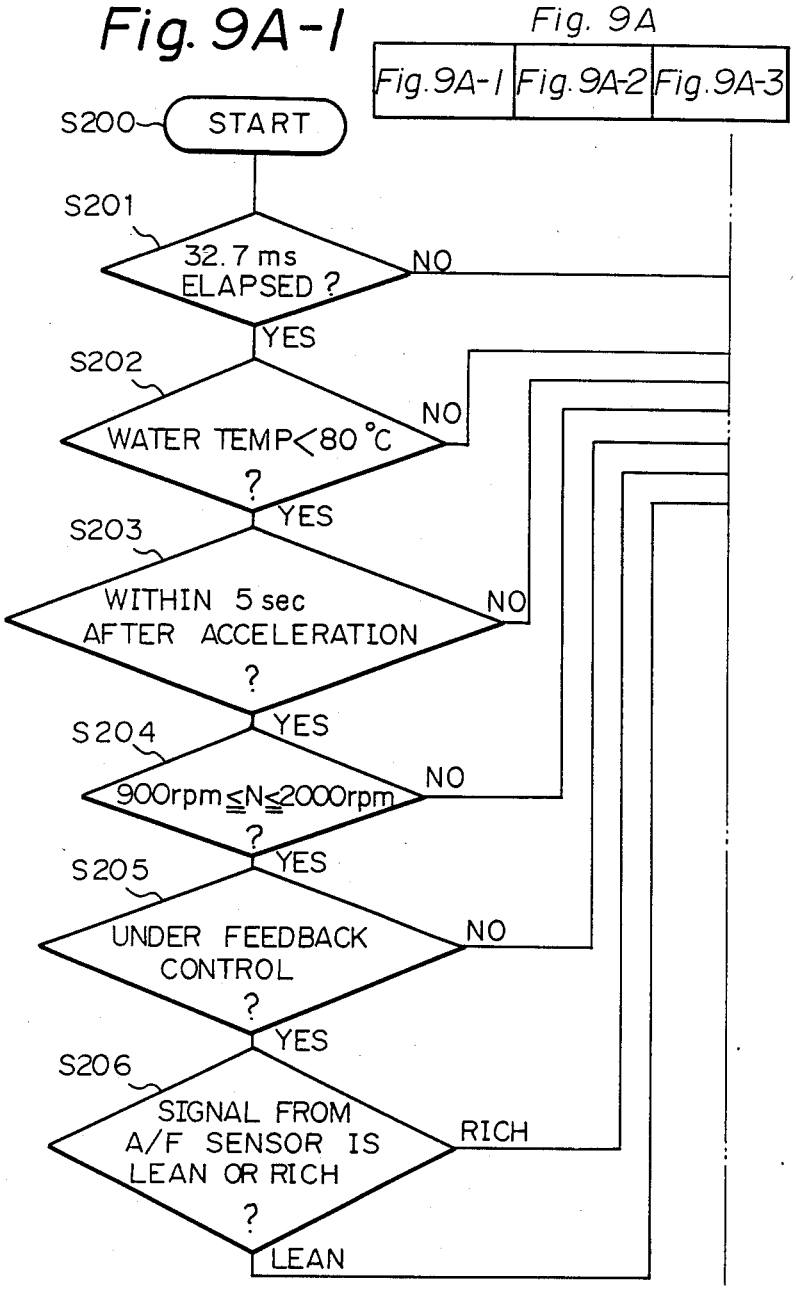
Figures 2, 9A:
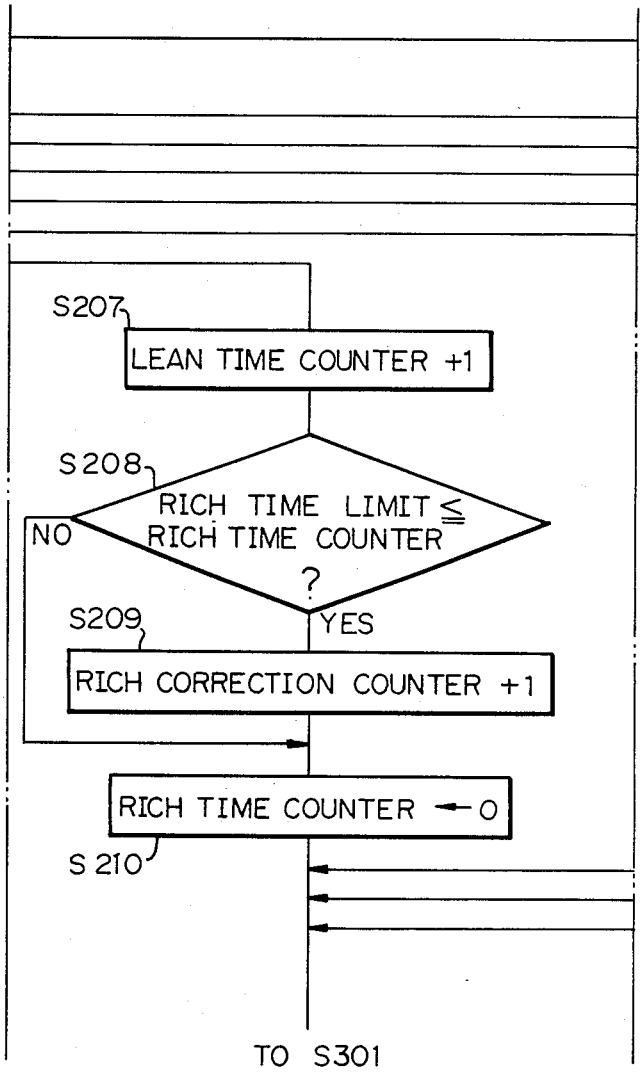
Figures 3, 9A:
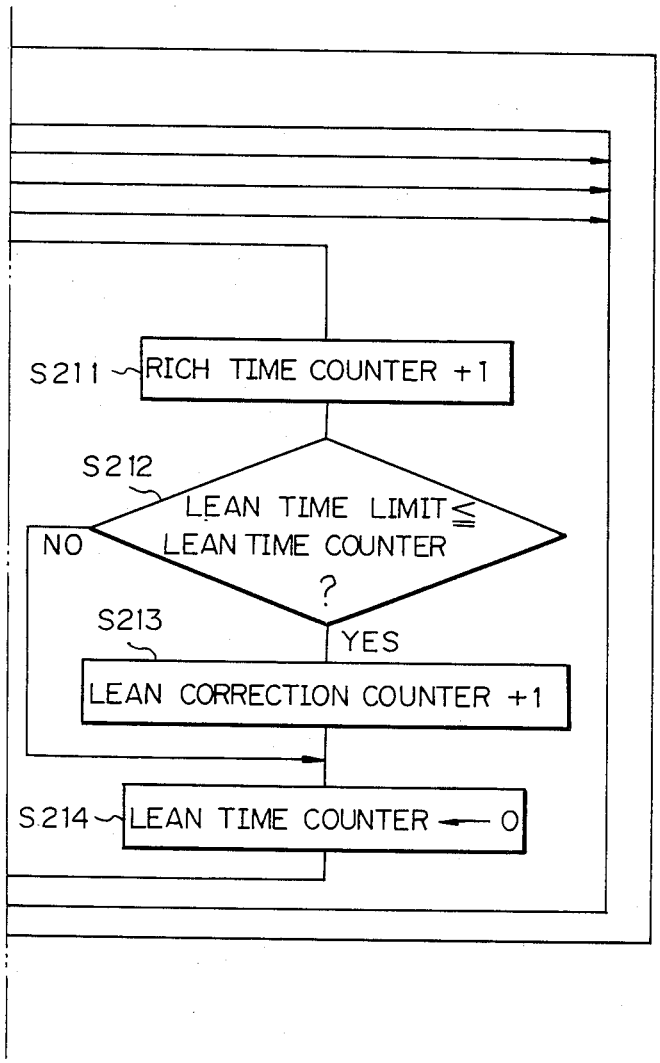
Figure 9B:
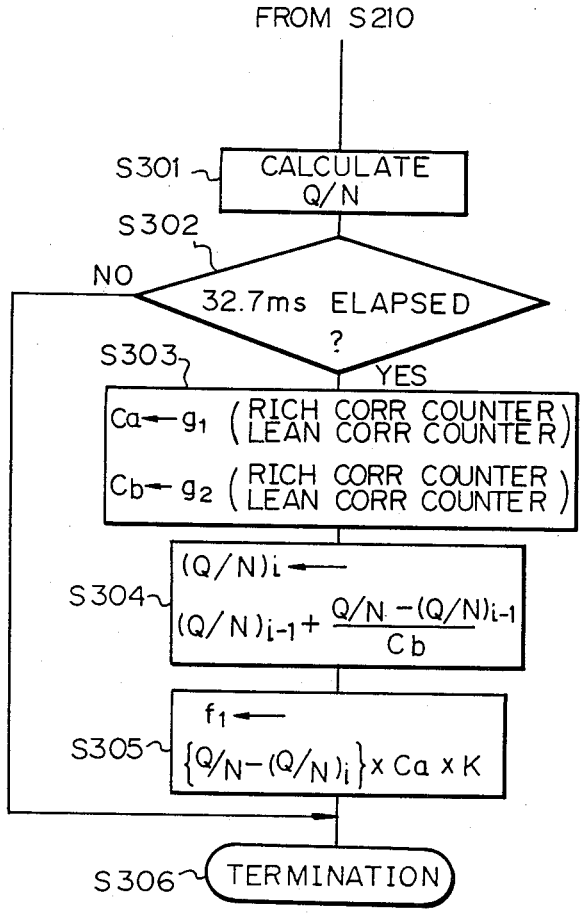
FIG. 9B is a detailed flow chart of the calculation of the correction of the amount of fuel in the transient state of the engine.

A detailed flow chart of the treatment of the air-fuel ratio deviation in the flow chart shown in FIG. 8 is shown in FIG. 9A. A detailed flow chart of the transient fuel amount correction in the flow chart shown in FIG. 8 is shown in FIG. 9B.

In the treatment of the air-fuel ratio deviation illustrated in FIG. 9A, the operation is carried out at a predetermined interval of, for example, 32.7 ms, as shown in step S201. In order to detect the air-fuel ratio deviation, the voltage of the output signal of the air-fuel ratio sensor 6 is compared with a predetermined voltage, the two values of the air-fuel ratio in a lean state and a rich state of the mixed gas are detected, and the lean-state duration T(LN) and the rich-state duration T(RCH) in the acceleration state are measured.

For example, the influence of deposits appears only when the coolant water temperature is low. In order to facilitate estimating the amount of deposits, in step S202, S203, and S204, the lean-state duration T(LN) and the rich-state duration T(RCH) under a coolant water temperature lower than 80° C., a timing of within 5 seconds after acceleration, and an engine speed of 900 rpm to 2000 rpm are measured. In step S205, the process is limited to the period of feedback control so as to realize alternate occurrences of a rich state and a lean state.

In step S206, the decision as to whether the ratio is rich or lean is carried out. When lean, in step S207, the lean time counter is incremented by 1 and counting of T(LN) with units of 32.7 ms is carried out. In step S208, the decision as to whether the count of the rich time counter exceeds a predetermined rich time limit is carried out. When the decision is YES, the count of the rich correction counter is incremented by 1 in step S209. In step S210, the count of the rich time counter is made 0. When the decision in step S206 is RICH, the increment by 1 of the rich-time counter and the decision concerning the lean time are carried out in steps S211 to S214.

It is possible to estimate the amounts of attachment and removal of deposits from the counts of the lean correction counter and the rich correction counter obtained in step S206 to S214. It is possible, accordingly, to estimate the change of the engine from a normal state to an abnormal state and the recovery from an abnormal state to a normal state.

In the transient fuel amount correction routine illustrated in FIG. 9B, in step S301, the intake air amount per rotation Q/N is calculated from the intake air amount signal Q from the intake air amount sensor 2 and the engine speed signal N from the engine speed sensor 3. In step S302, the decision whether a predermined period of, for example, 32.7 ms, has passed is carried out.

In step S303, a correction coefficient $C_a$ and a blunting coefficient $C_b$ are obtained as functions of the count of the rich correction counter and the count of the lean correction counter. The correction coefficient $C_a$ and the blunting coefficient $C_b$ are obtained as the coefficients corresponding to the air-fuel ratio deviation in the acceleration state.

In step S304, $(Q/N)_i$, which is a blunted value of Q/N, is calculated by the following equation.

$$(Q/N)_i=(Q/N)_{i-1}+\{Q/N-(Q/N)_{i-1}\}/C_b$$

where $(Q/N)_{i-1}$ is given as the value of $(Q/N)_i$ at 32.7 ms before.

In step S305, the calculation of the transient fuel amount correction ratio $f_1$ is carried out by the following equation on the basis of Q/N, $(Q/N)_i$, $C_a$, and K; in which $$f_1=\{Q/N-(Q/N)_i\}\times C_a\times K$$

where K is the correction ratio, corresponding to the coolant water temperature, for the cooling of the engine and is stored in a map. The value $f_1$ can be either positive or negative, depending on the change of Q/N. The correction is carried out by multiplying the fundamental fuel injection amount by the transient fuel amount correction ratio $f_1$.

As the result of the introduction of the blunting process into the correction calculation, the correction amount for fuel correction further approaches the desired value and, hence, the correction amount is decided more precisely.

Figure 10:
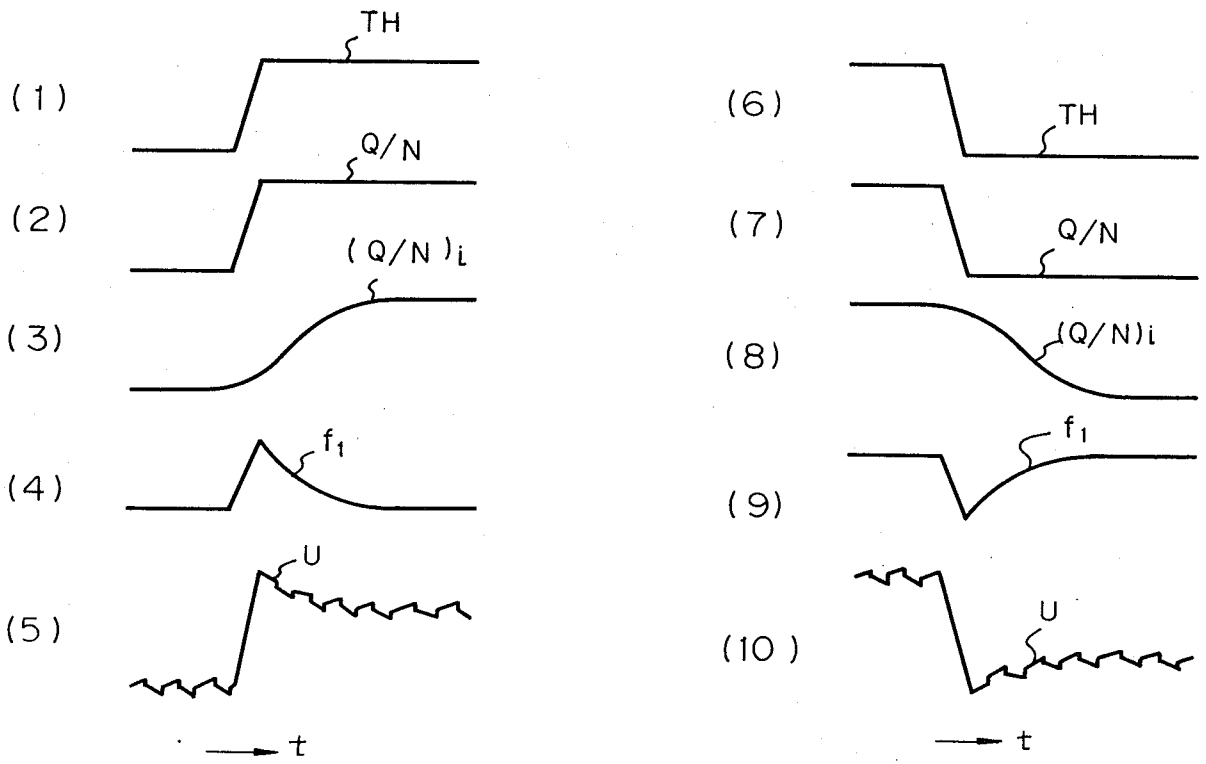
FIG. 10 illustrates waveforms representing the manner of fuel injection in the engine acceleration or deceleration state.

The change with time of the signals in accordance with the above-described transient fuel amount correction operation is illustrated in FIG. 10. When acceleration is carried out by increasing the opening degree (TH) of the throttle valve (FIG. 10, (1)), the value Q/N is increased (FIG. 10, (2)), the value $(Q/N)_i$ is gradually increased (FIG. 10, (3)), the transient fuel amount correction ratio $f_1$ is changed (FIG. 10, (4)), the fuel injection valve opening period U is decided (FIG. 10, (5)), and the fuel injection is carried out in accordance with the decided fuel injection valve opening period U.

When deceleration is carried out by decreasing the opening degree (TH) of the throttle valve (FIG. 10, (6)), the value Q/N is decreased (FIG. 10, (7)), the value $(Q/N)_i$ is gradually decreased (FIG. 10, (8)), the transient fuel amount correction ratio $f_1$ is changed (FIG. 10, (9)), the fuel injection valve opening period U is decided (FIG. 10, (10)), and the fuel injection is carried out in accordance with the decided fuel injection valve opening period U.

Figure 11:
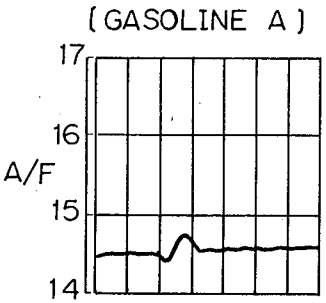
FIGS. 11 and 12 illustrate the manner of the operation of the apparatus shown in FIG. 2 with the use of different kinds of gasoline.
Figure 12:
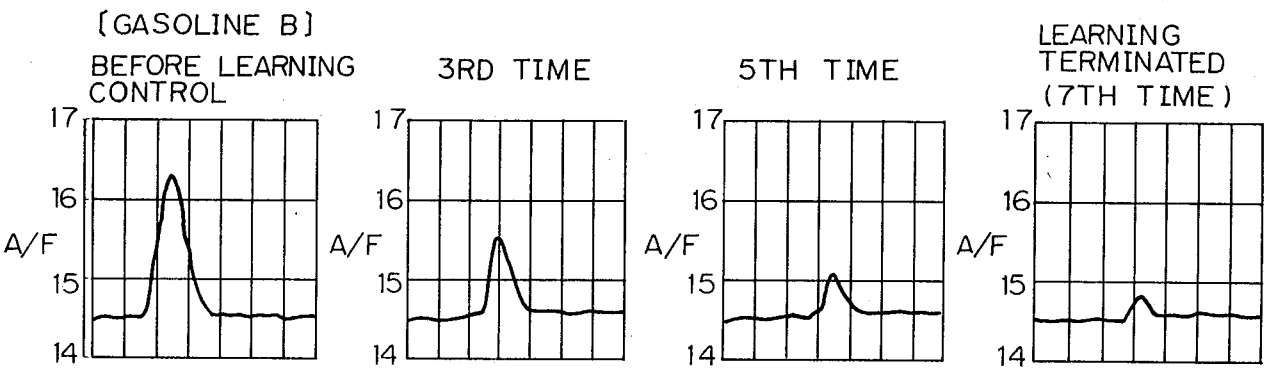

The manner of operation of the apparatus shown in FIG. 2 is shown in FIGS. 11 and 12. The conditions are selected so that the engine speed is 1000 rpm, the coolant water temperature is 30° C., the acceleration is carried out by the operation of the throttle, and the acceleration is effected quickly from intake air pressure "−400 mmHg" to "−100 mmHg". FIG. 11 represents the change with time of the air-fuel ratio where gasoline A is used. FIG. 12 represents the change with time of the air-fuel ratio where gasoline B is used and learning control is carried out by the apparatus shown in FIG. 2.

As shown in FIGS. 11 and 12, the optimum air-fuel ratio is almost attained in the acceleration state with the use of gasoline A which has a 10% recovered temperature of 47° C. and a Reid vapor pressure of 0.72 kg/cm$^2$. In the case where the gasoline B of low volatility which has a 10% recovered temperature of 54° C. and a Reid vapor pressure of 0.6 kg/cm$^2$ is used, the air-fuel ratio once becomes relatively lean. After that, however, it is possible to attain the same air-fuel ratio characteristic as in the case of the use of gasoline A at the seventh process after execution of the learning processes in the apparatus shown in FIG. 2. Such number of learning processes can be reduced by increasing the amount of correction.

Modified or alternative embodiments of the present invention are possible. While the calculations of $(Q/N)_i$ are carried out at a predetermined interval of, for example, 32.7 ms, in step S302 in the above-described embodiment, the calculations can be carried out in synchronization with the rotation of the engine, for example, once per rotation, as illustrated in the flow chart shown in FIG. 13.

Figure 13:
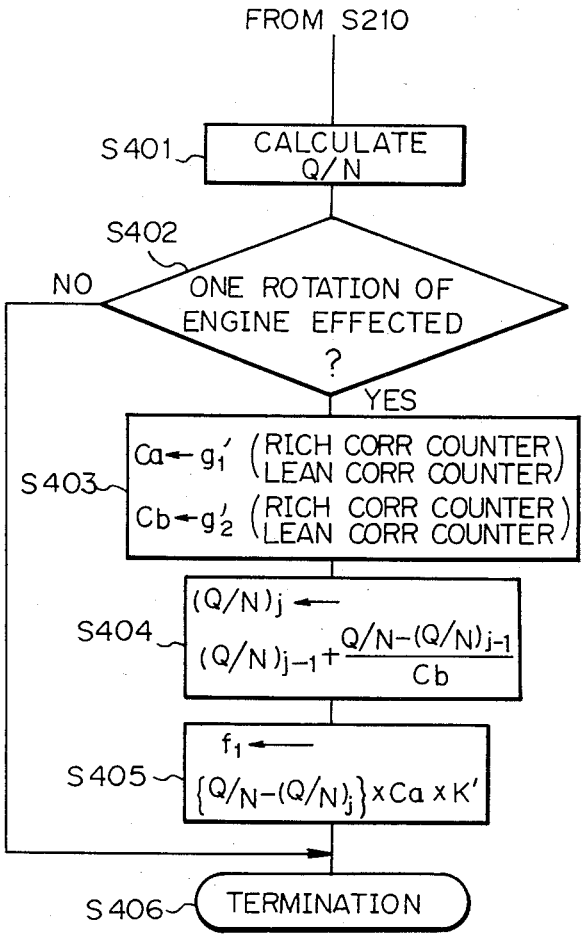
FIG. 13 is a flow chart of a modification of the operation illustrated in the flow chart of FIG. 9B.

In the flow chart shown in FIG. 13, in step S401, Q/N is calculated. In step S402, the decision as to one rotation of the engine is carried out. In step S403, the correction coefficient $C_a$ and the blunting coefficient $C_b$ are calculated as functions of the counts of the rich correction counter and the lean correction counter. Thus, the correction coefficient $C_a$ and the blunting coefficient $C_b$ are obtained in correspondence to the air-fuel ratio deviation in the acceleration state.

In step S404, a blunted value $(Q/N)_j$ is calculated from Q/N in accordance with the following equation:

$$(Q/N)_j = (Q/N)_{j-1} + \{Q/N - (Q/N)_{j-1}\}/C_b$$

where $(Q/N)_{j-1}$ is the value calculated at one rotation prior to $(Q/N)_j$.

In step S405, the transient air-fuel ratio correction ratio $f_1$ is calculated from Q/N, $(Q/N)_j$, $C_a$, and K' depending on the coolant water temperature in accordance with the following equation:

$$f_1 = \{Q/N - (Q/N)_j\} \times C_a \times K'$$

Then, the correction is carried out by multiplying the fundamental fuel injection amount by $f_1$.

In such a method for obtaining $(Q/N)_j$ in synchronization with engine rotation, the number of combustion cycles which contribute to the fuel amount increase or fuel amount decrease due to the transient air-fuel ratio correction ratio $f_1'$ becomes almost constant, regardless of the engine speed, under the same acceleration condition. Thus, variation of transient air-fuel ratio in various engine running conditions is prevented.

The period for detecting the air-fuel ratio deviation is limited to within 5 seconds from the occurrence of acceleration in step S203 in the above-described embodiment. It is also possible, however, to carry out detection by measuring T(LN) and T(RCH) in the deceleration state, as understood from the illustrations of FIGS. 4 and 5.

The fuel amount increase is carried out on the basis of the intake air amount Q/N and the blunted amount of the intake air amount Q/N in the above-described embodiment. It is also possible, however, to carry out the fuel amount increase on the basis of other values, such as the intake-air vacuum value, the opening degree of the throttle valve, and the blunted values thereof.

The fuel amount increase is carried out on the basis of the difference between the factor for decision of the correction amount and the blunted value thereof in the above-described embodiment. It is also possible to carry out the fuel amount increase on the basis of the difference between the factor for decision of the correction amount and the factor for decision of the correction obtained at the preceding calculation timing.

As an embodiment according to another aspect of the present invention, in order to detect the transient running state of an internal combustion engine and increase accordingly the amount of fuel injection in the transient running state, the detection of the air-fuel ratio deviation from a reference air-fuel ratio and the correction of the value of increase of fuel injection in the transient running state on the basis of the detected air-fuel ratio deviation are carried out. Also, the selection of the reference air-fuel ratio to be an air-fuel ratio which is richer than the stoichiometrical air-fuel ratio is carried out.

Figures 1, 14, 14A:
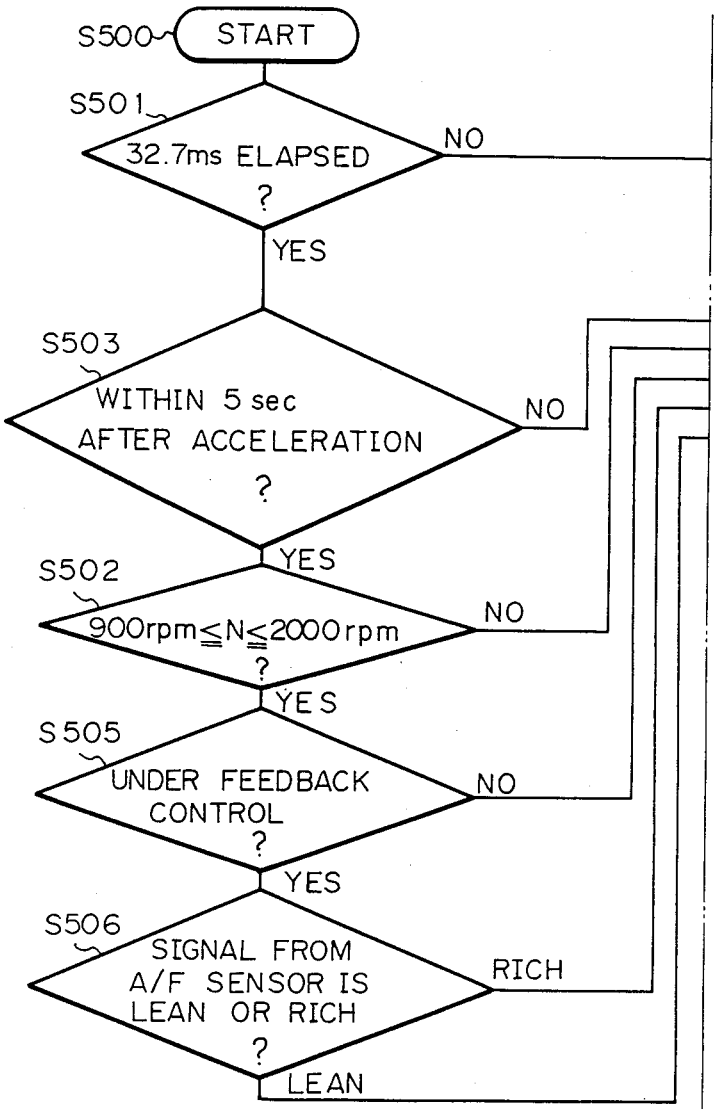
Figures 2, 14A:
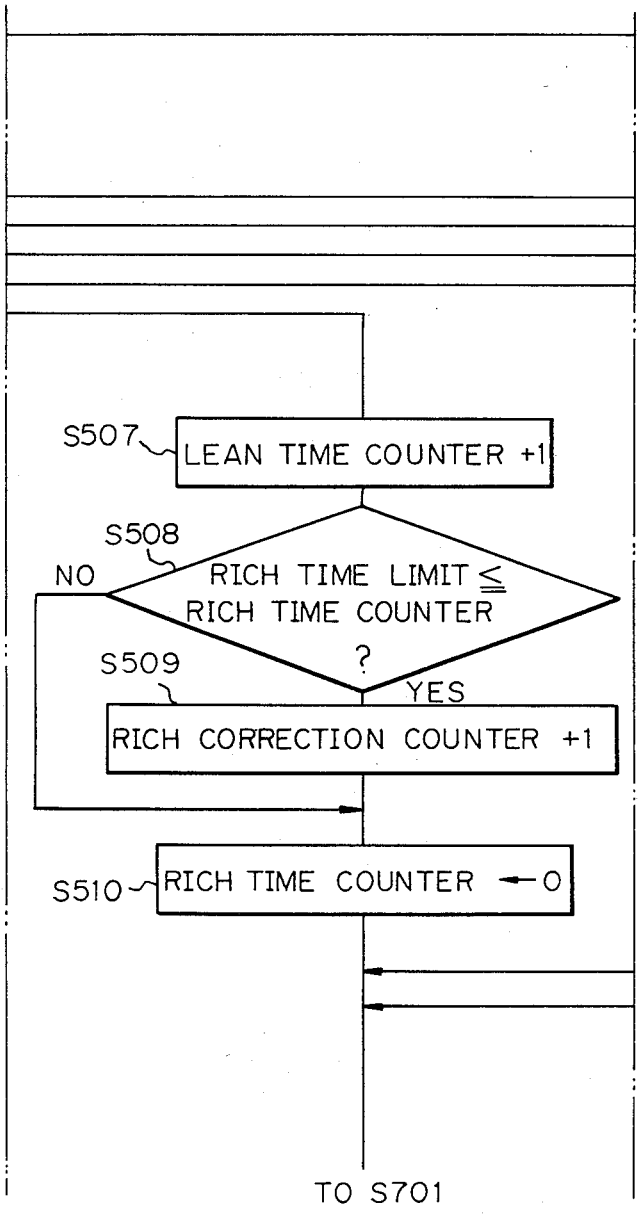
Figures 3, 14A:
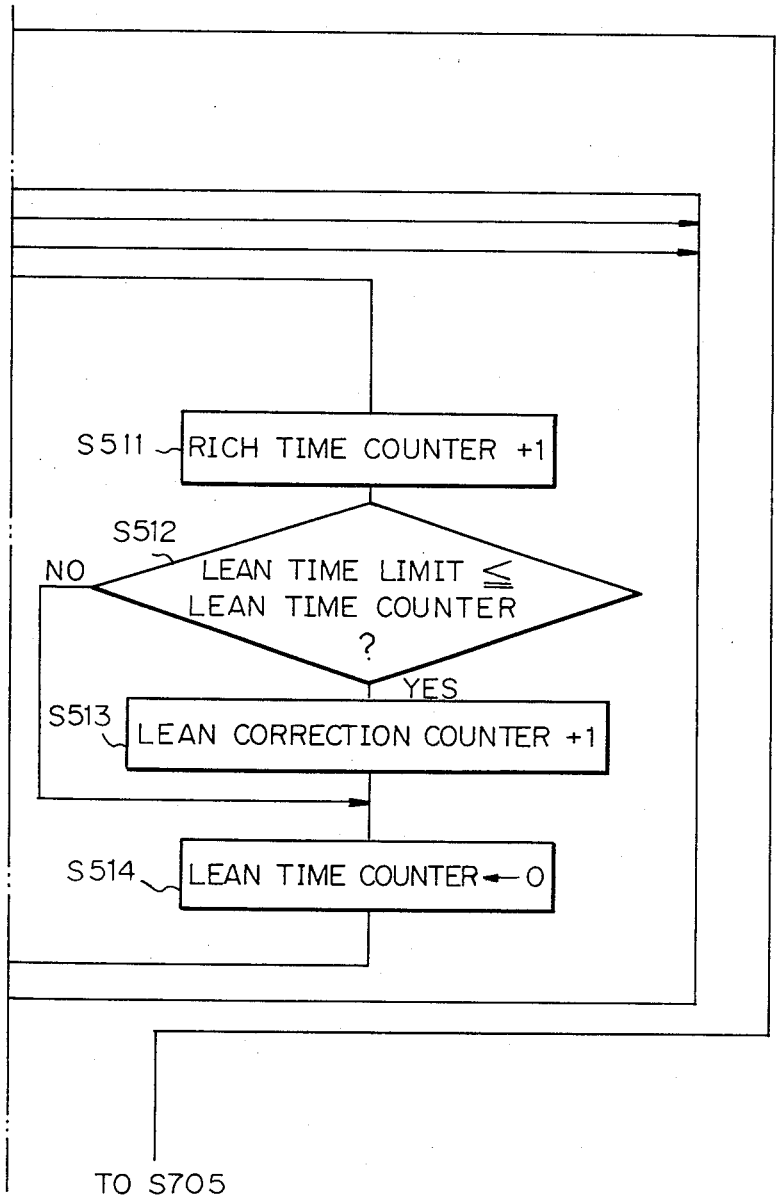
Figure 14B:
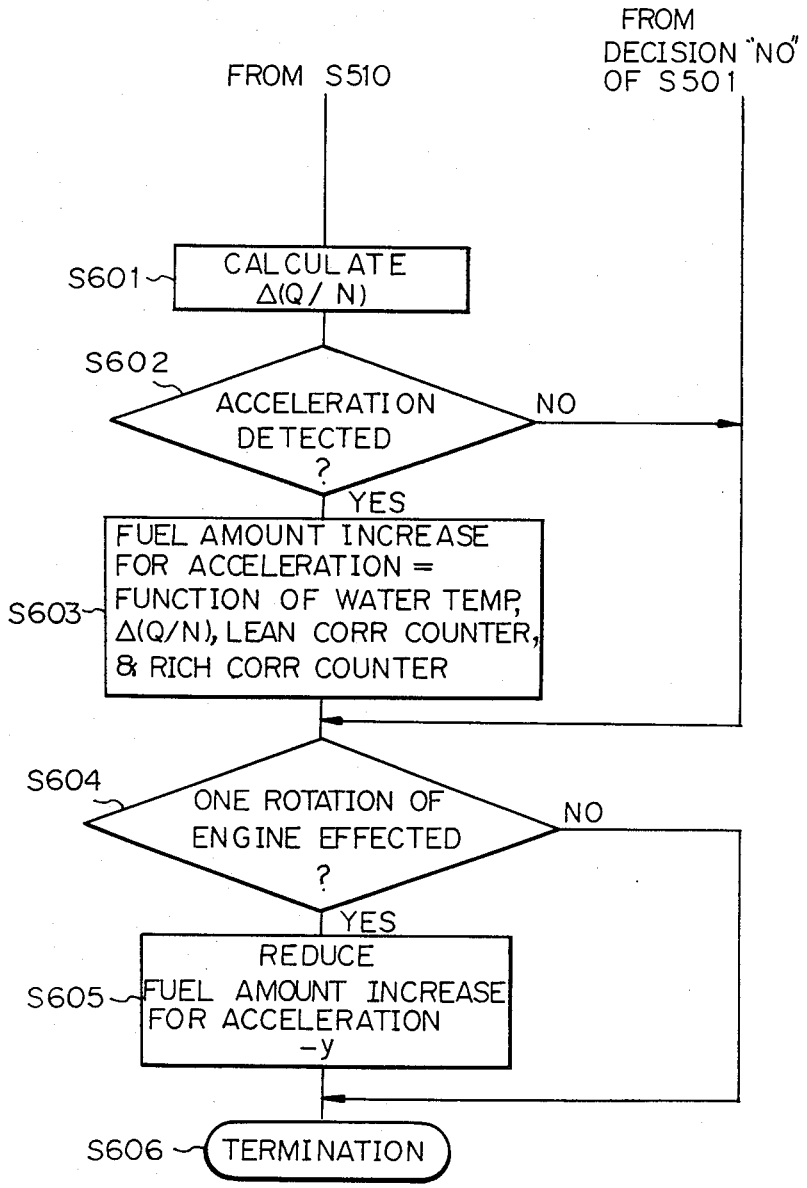

A flow chart of the processes of detection and treatment of the air-fuel ratio deviation in this embodiment is shown in FIG. 14A. A flow chart of the processes of the increase of the amount of fuel injection in the acceleration state and the correction of the amount of fuel injection corresponding to the increased fuel injection amount in the acceleration state is shown in FIG. 14B.

In the flow chart shown in FIG. 14A, in step S502, treatment is carried out at a predetermined interval, for example, 32.7 ms. In order to detect the air-fuel ratio deviation, the output signal of the air-fuel ratio sensor 6 is compared with a predetermined voltage, two values corresponding to a lean state and a rich state of the mixed gas are detected, and lean-state duration T(LN) and rich-state duration T(RCH) are measured.

In order to facilitate the detection of the air-fuel ratio deviation in the transient running state, the lean-state duration T(LNS) and the rich-state duration T(RCH) within 5 seconds from the occurrence of acceleration of the engine from 900 rpm to 2000 rpm are measured in step S503 and step S504. In step S505, the process is limited to the period of the feedback contol operation in order to realize the alternate occurrrences of rich and lean states.

In step S506, a decision whether the state is a rich state or a lean state is carried out. When the decision is a lean state, the count of the lean time counter is incremented by 1 and T(LN) is calculated with a unit of 32.7 ms in step S507. In step S508, a decision whether or not the count of the rich time counter exceeds a predetermined value, which is a rich time limit, is carried out. When the decision is YES, the count of the rich correction counter is incremented by 1 in step S509. In step S510, the count of the rich time counter is made 0.

When the decision in step S506 is a rich state, the increment by 1 of the rich time counter and the decision concerning the lean time are carried out in steps S511 to S514. From the counts of the lean correction counter and the rich correction counter obtained in steps S506 to S514, the degree of the air-fuel ratio deviation in the acceleration state can be known.

The count T(RCH) of the rich-time counter can be selected to be a desired value by selecting the rich-time limit in step S508. In the apparatus shown in FIG. 2, the value of the rich-time limit is selected to be greater than the rich-time limit for the control for realizing the stoichiometrical air-fuel ratio, in order to select the air-fuel ratio in the acceleration state to be a little richer than the stoichiometrical air-fuel ratio, the air-fuel ratio in the acceleration state is controlled to attain a relatively rich air-fuel ratio accordingly, and the drivability of the engine is enhanced accordingly.

Since the values of T(RCH) and D[A/F(RCH)] are decided as single values from FIGS. 4 and 5, the value of D[A/F(RCH)] can be limited within the rich-time limit. Hence, the air-fuel ratio is limited precisely to a predetermined rich air-fuel ratio. Accordingly, emission is prevented from deteriorating and the drivability is maintained in good condition.

It is also possible, in the air-fuel ratio control in the acceleration state, to change the value of the rich-time limit in accordance with the coolant water temperature and to make variable the air-fuel ratio, which is controlled to be rich in low-temperature conditions.

In the flow chart shown in FIG. 14B, in step S601, the rate Δ(Q/N) of change of intake air amount per engine rotation Q/N is calculated from the signal Q of the intake air amount from the intake air amount sensor 2 and the signal N of the engine speed from the engine speed sensor 3. When the calculated rate Δ(Q/N) is positive, the engine is considered to be in the acceleration state. When Δ(Q/N) is decided as being positive and greater than a predetermined value in step S602, the engine running state is acknowledged as being in the acceleration state, and the process proceeds to step S603 accordingly.

In step S603, the value of the fuel amount increase in the acceleration is calculated as a function of the coolant water temperature, the change rate Δ(Q/N), the count of the lean correction counter, and the count of the rich correction counter. This calculation is carried out fundamentally by preliminarily storing the ratio of fuel amount increase per unit change rate Δ(Q/N) corresponding to the coolant water temperature in the form of a map, reading from the map the desired ratio of fuel amount increase in accordance with coolant water temperature, multiplying the read fuel amount increase ratio by Δ(Q/N), and carrying out a correction using the counts of the lean correction counter and the rich correction counter. As a result, the value of fuel amount increase in the acceleration state is calculated. This calculated value is treated as the initial value for the time of detection of the acceleration of the engine. In steps S604 and S605, the value of the fuel amount increase is reduced by a predetermined value per engine rotation until the value of the fuel amount increase is reduced to 0.

Figure 15:
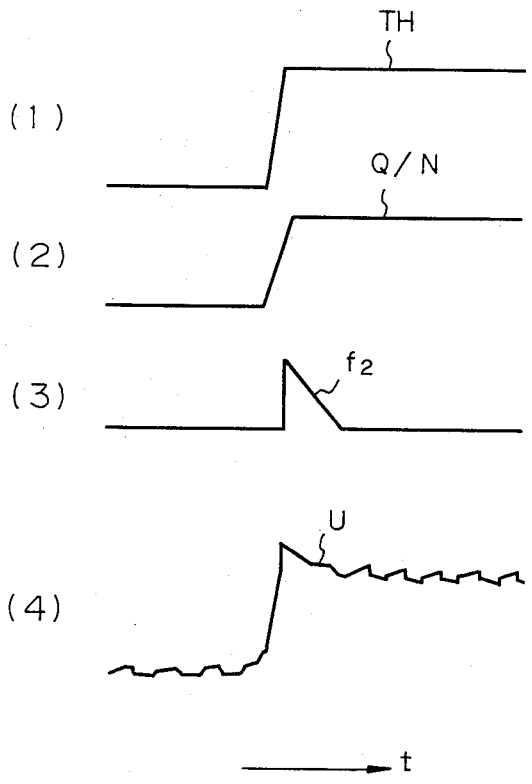
FIG. 15 illustrates waveforms representing the manner of fuel injection corresponding to the flow charts shown in FIGS. 14A(1-3) and 14B.

The changes with time of the signals concerning the flow chart shown in FIGS. 14A and 14B are shown in FIG. 15. The change of the opening degree TH of the throttle valve in the acceleration state (FIG. 15, (1)), the change of Q/N (FIG. 15, (2)), the change of the ratio $f_2$ of the fuel amount increase in the acceleration state (FIG. 15, (3)), and the change of the opening time U of the fuel injection valve (FIG. 15, (4)), are illustrated.

Modified or alternative embodiments are also possible. In the above-described embodiment, the initial value of the fuel increase amount in the acceleration state in the case with deposits is changed in accordance with the counts of the lean correction counter and the rich correction counter. It is also possible to carry out the decision of the fuel amount increase in the acceleration state on the basis of only the coolant water temperature $\theta_W$ and the change rate Δ(Q/N), regardless of the air-fuel ratio deviation, as illustrated in the flow chart shown in FIG. 16. It is also possible to carry out a corrected fuel amount increase in the acceleration state corresponding to the air-fuel ratio deviation, in addition to the above-described decided fuel amount increase.

Figure 16:
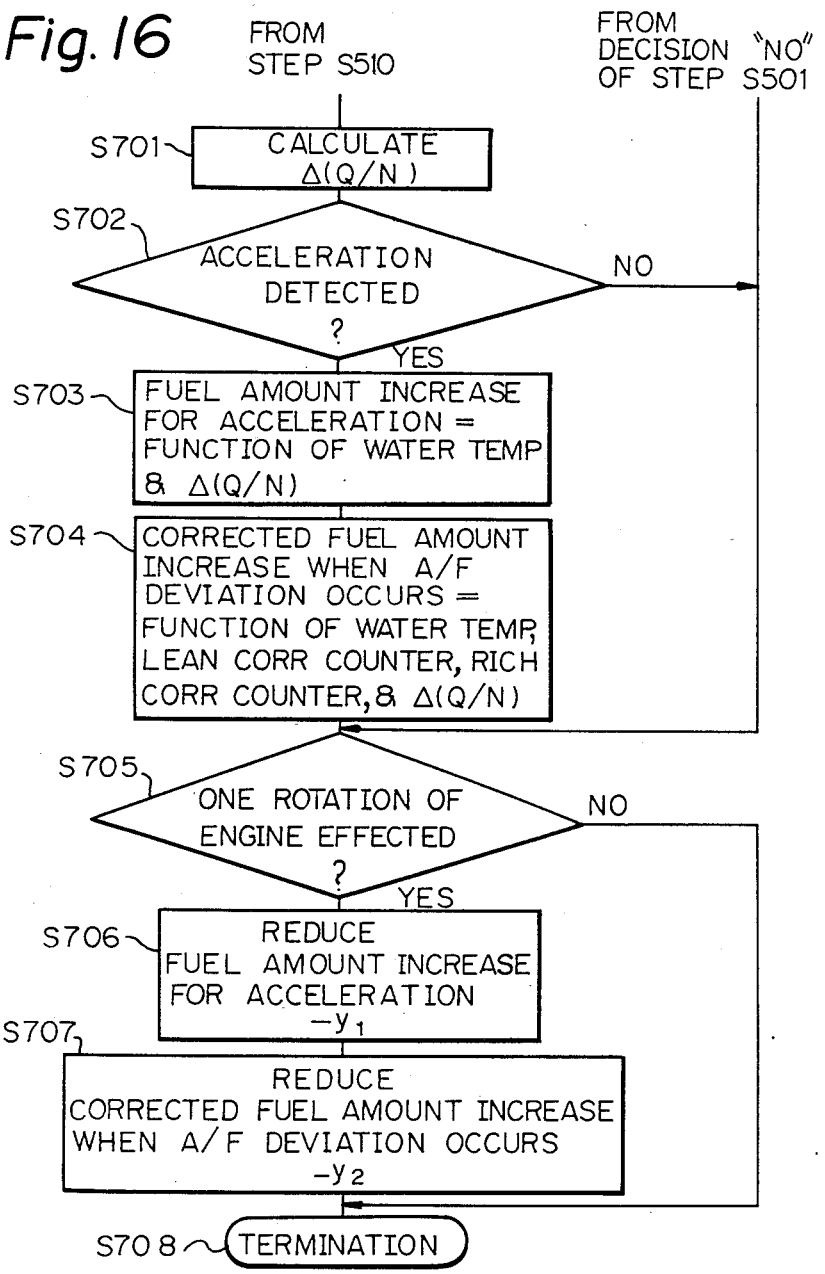
FIG. 16 is a flow chart of the control operation according to a further embodiment of the present invention.

In the flow chart shown in FIG. 16, in step S702, the acceleration of the engine is detected. In step S703, the value of fuel amount increase in the acceleration state is obtained on the basis of only the coolant water temperature and the change rate Δ(Q/N). In step S704, the corrected value of the fuel amount increase in the case where a deviation of air-fuel ratio occurs is calculated. In this calculation, a value of correction of the fuel amount increase in the acceleration state according to the value corresponding to the air-fuel ratio deviation is calculated as a function of four variables: the coolant water temperature, the count of the lean correction counter, the count of the rich correction counter, and the change rate Δ(Q/N). In steps S705, S706, and S707, the value of fuel amount increase in the acceleration state is reduced by a predetermined value $y_1$, and the correction value of fuel amount increase in the acceleration state in the case where a deviation of air-fuel ratio occurs is reduced by a predetermined value $y_2$, until the result of such reduction reaches 0. The value of increase of amount of fuel injection is obtained by multiplying the fundamental fuel injection amount by the fuel amount increase ratio in the acceleration state and the corrected fuel amount increase ratio for the fuel amount increase in the acceleration state.

We claim:

1. A method for controlling air-fuel ratio in an internal combustion engine comprising the steps of:

(1) every time the engine has rotated through a predetermined crank angle, obtaining a factor value for deciding a correction amount of fuel injection corresponding to an acceleration/deceleration state of the engine;

(2) calculating the blunted value of said obtained factor value obtained by said obtaining step (1);

(3) obtaining a correction amount of transient fuel injection from said factor value obtained by said obtaining step (1) and said blunted factor value calculated by said calculating step (2);

(4) detecting deviation of the air-fuel ratio of said engine from a predetermined reference air-fuel ratio during the acceleration or deceleration of the engine;

(5) correcting said correction amount of transient fuel injection obtained by said obtaining step (3) in response to said air-fuel ratio deviation detected by said detected step (4) every time the engine has rotated through said predetermined crank angle; and (6) supplying the engine with an amount of fuel controlled by said transient fuel injection correction amount as corrected by said correcting step (5).

2. A method according to claim 1, wherein said obtaining step (3) includes the step of calculating the differenece between the factor value for deciding a correction amount of fuel injection obtained by said obtaining step (1) and the blunted value of the above-mentioned factor value calculated by said calculating step (2).

3. A method for controlling air-fuel ratio in an internal combustion engine comprising the steps of:

(1) every time the engine has rotated through a predetermined crank angle obtaining a factor value for deciding a correction amount of fuel injection corresponding to the acceleration/deceleration state of an engine;

(2) calculating a blunted value of said factor value obtained by said obtained step (1);

(3) obtaining a correction amount of transient fuel injection from said factor value obtained by said obtaining step (1) and said blunted factor value calculated by said calculating step (2);

(4) detecting deviation of the air-fuel ratio of said engine from a predetermined reference air-fuel ratio during the acceleration or deceleration of the engine;

(5) regulating at least one engine parameter independent of the degree of acceleration or deceleration in accordance with said detected air-fuel ratio deviation;

(6) correcting said correction amount of transient fuel injection obtained by said obtaining step (3) in response to said regulated parameter every time the engine has rotated through said predetermined crank angle; and (7) supplying the engine with an amount of fuel controlled by said correction amount as corrected by said correcting step (6).

4. A method according to claim 3, wherein:

said method further includes the step of detecting the air-fuel ratio of said engine; and said regulating step (5) includes the step of increasing or decreasing said parameter in accordance with said detected air-fuel ratio.

5. A method according to claim 3, wherein said predetermined reference air-fuel ratio is the stoichiometrical air-fuel ratio.

6. A method according to claim 3, wherein said blunted factor value calculating step (2) includes the step of changing the factor value with engine acceleration or deceleration at a constant interval.

7. A method according to claim 3, wherein said calculating step (2) includes the step of changing the factor value with engine acceleration or deceleration in synchronization with the rotation of the engine.

8. A method for controlling air-fuel ratio in an internal combustion engine comprising the steps of:

(1) obtaining a correction amount of transient fuel injection for the engine;

(2) calculating a predetermined reference air-fuel ratio richer than the stoichiometrical air-fuel ratio of said engine;

(3) detecting deviation of the air-fuel ratio from said predetermined reference air-fuel ratio calculated by said calculating step (2) during the acceleration of the engine;

(4) correcting the correction amount of transient fuel injection obtained by said obtaining step (1) in response to said deviation of the air-fuel ratio detected by said detecting step (3) every time the engine has rotated through a predetermined crank angle; and (5) supplying the engine with an amount of fuel controlled by said correction amount as corrected by said correcting step (4);

wherein the actual air-fuel ratio of said engine is richer than the stoichiometrical air-fuel ratio only during acceleration.

9. A method according to claim 8, wherein said predetermined reference air-fuel ratio is richer than the stoichiometrical air-fuel ratio, and the actual air-fuel ratio becomes richer as the temperature of the engine becomes lower only when the engine is in a transient state.

10. A method according to claim 9, wherein said deviation of the air-fuel ratio from a predetermined reference air-fuel ratio is caused by a deposit existing in an air intake passage of the engine.

11. A method of controlling the air-to-fuel ratio of an internal combustion engine comprising the steps of:

(1) determining a steady-state air-to-fuel injection value in response to at least one engine operating parameter;

(2) sensing the actual air-to-fuel ratio of said engine;

(3) correcting said value determined by said determining step (1) in response to said actual ratio sensed by said sensing step (2) to maintain constant air-to-fuel ratio;

(4) sensing the amount Q/N of air intake of said engine per unit of engine rotation;

(5) determining if said engine is accelerating or decelerating;

(6) if said engine is accelerating or decelerating, detecting the duration of a deviation in said air-to-fuel ratio sensed by said sensing step (2) resulting from said acceleration/deceleration;

(7) calculating an optimum amount of air intake per unit engine rotation $Q/N_i$ in response to said amount Q/N sensed by said sensing step (4) and said duration detected by said detecting step (6);

(8) further correcting said previously-corrected fuel injection value produced by said correcting step (3) in response to said optimum amount $Q/N_i$ and in response to said duration detected by said detecting step (6); and (9) controlling the operation of at least one fuel injector of said engine in accordance with said fuel injection value corrected by said correcting steps (3) and (8).

12. A method as in claim 11 wherein:

said method further includes the steps of:

(a) subsequent to said calculating step (7), storing said calculated optimum amount $Q/N_i$, and (b) periodically repeating at least said sensing step (4) through said controlling step (9);

said calculating step (7) optimizes said amount $Q/N_i$ also in response to the amount $Q/N_{i-1}$ stored by said storing step (a) during the last repetition of said storing step; and said further correcting step (8) also corrects said previously-corrected fuel injection value in response to the optimum amount $Q/N_{i-1}$ stored by said storing step (a) during the last repetition of said storing step.

13. A method as in claim 12 wherein said calculating step (7) includes the steps of:

(x) calculating the difference between said amount Q/N sensed by said sensing step (4) and the optimum amount $Q/N_{i-1}$ stored by said storing step (a) during the last repetition of said storing step;

(y) multiplying said difference calculated by said calculating step (x) by a factor proportional to said duration detected by said detecting step (6) to produce a product; and (z) adding said product produced by said multiplying step (y) to the stored optimum amount $Q/N_{i-1}$ to obtain a new optimum amount $Q/N_i$.

14. method as in claim 12 wherein said further correcting step (8) includes the steps of:

(n) calculating the difference between said amount Q/N sensed by said sensing steps (4) and the optimum amount $Q/N_{i-1}$ stored by said storing step (a) during the last repetition of said storing step;

(o) multiplying said difference calculated by said calculating step (n) by a factor proportional to said duration detected by said detecting step (6) to produce a fuel correction amount $f_1$; and (p) correcting said previously-corrected fuel injection value in response to said fuel correction amount $f_1$.

15. A method as in claim 11 wherein said deviation detecting step (6) includes the steps of:

determining whether at least one engine operating parameter is within a predetermined range;

if said parameter is within said predetermined range, comparing said actual ratio sensed by said sending step (2) with a predetermined reference air-to-fuel ratio; and determining the period of time during which said sensed air-to-fuel ratio exceeds or is less than said predetermined reference value.

16. A method as in claim 15 wherein said range determining step includes at least one of the following steps:

determining if the temperature of the coolant of said engine is below a predetermined reference value;

determining if the speed of said engine is within a predetermined range; and determining whether less than a predetermined period of time has elapsed since said engine was last accelerated.

17. An apparatus for controlling air-fuel ratio in an internal combustion engine comprising:

means for obtaining a factor value for deciding a correction amount of fuel injection corresponding to an acceleration/deceleration state of the engine every time the engine has rotated through a predetermined crank angle;

means for calculating the blunted value of said obtained factor value obtained by said factor value obtaining means;

means for obtaining a correction amount of transient fuel injection from said factor value obtained by said factor value obtaining means and said blunted value calculated by said calculating means;

means for detecting deviation of the air-fuel ratio of said engine from a predetermined reference air-fuel ratio during the acceleration or deceleration of the engine;

means for correcting said correction amount of transient fuel injection obtained by said factor value obtaining means in response to said air-fuel ratio deviation detected by said detecting means every time the engine has rotated through said predetermined crank angle; and means for supplying the engine with an amount of fuel controlled by said transient fuel injection correction amount as corrected by said correcting means.

18. An apparatus according to claim 17, wherein said correction amount obtaining means includes means for calculating the difference between the factor value for deciding a correction amount of fuel injection obtained by said factor value obtaining means and the blunted value of the above-mentioned factor calculated by said calculating means.

19. A system for controlling air-fuel ratio in an internal combustion engine comprising:

means for obtaining a factor value for deciding a correction amount of fuel injection corresponding to the acceleration/deceleration state of an engine every time the engine has rotated through a predetermined crank angle;

means for calculating a blunted value of said factor value obtained by said factor value obtaining means;

means for obtaining a correction amount of transient fuel injection from said factor value obtained by said factor value obtaining means and said blunted factor value calculated by said calculating means;

means for detecting deviation of the air-fuel ratio of said engine from a predetermined reference air-fuel ratio during the acceleration or deceleration of the engine;

means for regulating at least one engine parameter independent of the degree of acceleration or deceleration in accordance with said detected air-fuel ratio deviation;

means for correcting said correction amount of transient fuel injection obtained by said correction amount obtaining means in response to said regulated parameter every time the engine has rotated through said predetermined crank angle; and means for supplying the engine with an amount of fuel controlled by said correction amount as corrected by said correcting means.

20. A system according to claim 19, wherein:

said system further includes the step of detecting the air-fuel ratio of said engine; and said regulating means includes means for increasing or decreasing said parameter in accordance with said detected air-fuel ratio.

21. A system according to claim 19, wherein said predetermined reference air-fuel ratio is the stoichiometrical air-fuel ratio.

22. A system according to claim 19, wherein said blunted factor value calculating means includes means for changing the factor value with engine acceleration or deceleration at a constant interval.

23. A system according to claim 19, wherein said calculating means changes the factor value with engine acceleration or deceleration in synchronization with the rotation of the engine.

24. An apparatus for controlling air-fuel ratio in an internal combustion engine comprising:

means for obtaining a correction amount of transient fuel injection for the engine;

means for calculating a predetermined reference air-fuel ratio richer than the stoichiometrical air-fuel ratio of said engine;

means for detecting deviation of the air-fuel ratio from said predetermined reference air-fuel ratio calculated by said calculating means during the acceleration of the engine;

means for correcting the correction amount of transient fuel injection obtained by said correcting amount obtaining means in response to said deviation of the air-fuel ratio detected by said detecting means every time the engine has rotated through a predetermined crank angle; and means for supplying the engine with an amount of fuel controlled by said correction amount as corrected by said correcting means, wherein the actual air-fuel ratio of said engine is richer than the stoichiometrical air-fuel ratio only during acceleration.

25. An apparatus according to claim 24, wherein said predetermined reference air-fuel ratio is richer than the stoichiometrical air-fuel ratio, and the actual air-fuel ration becomes richer as the temperature of the engine becomes lower only when the engine is in a transient state.

26. An apparatus according to claim 25, wherein said deviation of the air-fuel ratio from a predetermined reference air-fuel ratio is caused by a deposit existing in an air intake passage of the engine.

27. A system for controlling the air-to-fuel ratio of an internal combustion engine comprising:

means for determining a steady-state air-to-fuel injection value in response to at least one engine operating parameter;

means for sensing the actual air-to-fuel ratio of said engine;

means for correcting said value determined by said determining means in response to said actual ratio sensed by said sensing means to maintain constant air-to-fuel ratio;

means for sensing the amount Q/N of air intake of said engine per unit of engine rotation;

means for determining if said engine is accelerating or decelerating;

means for detecting the duration of a deviation in said air-to-fuel ratio sensed by said sensing means resulting from said acceleration/deceleration of said engine whenever said engine is accelerating or decelerating;

means for calculating an optimum amount of air intake per unit engine rotation $Q/N_i$ in response to said amount Q/N sensed by said detecting means;

means for further correcting said previously-corrected fuel injection value produced by said correcting means in response to said optimum amount $Q/N_i$ and in response to said duration detected by said detecting means; and means for controlling the operation of at least one fuel injector of said engine in accordance with said fuel injection value corrected by said correcting and further correcting means.

28. A system as in claim 27 wherein:

said system further includes means for storing said calculated optimum amount $Q/N_{i-1}$;

said calculating means optimizes said amount $Q/N_i$ also in response to the amount $Q/N_{i-1}$ stored by said storing means; and said further correcting means also corrects said previously-corrected fuel injection value in response to the optimum amount $Q/N_{i-1}$ stored by said storing means.

29. A system as in claim 28 wherein said calculating means:

(x) calculates the difference D between said amount Q/N sensed by said sensing means and the optimum amount $Q/N_{i-1}$ stored by said storing means;

(y) multiplies said difference D by a factor proportional to said duration detected by said detecting means to produce a product; and (z) adds said product to he stored optimum amount $Q/N_{i-1}$ to obtain a new optimum amount $Q/N_i$.

30. A system as in claim 28 wherein said further correcting means:

(n) calculates the different E between said amount Q/N sensed by said sensing means and the optimum amount $Q/N_{i-1}$ stored by said storing means;

(o) multiplies said difference E by a factor proportional to said duration detected by said detecting means to produce a fuel correction amount $f_1$; and (p) corrects said previously-correct fuel injection value in response to said fuel correction amount $f_1$.

31. A system as in claim 27 wherein said deviation detecting means includes:

means for determining whether at least one engine operating parameter is within a predetermined range:

means for comparing said actual ratio sensed by said sensing means with a predetermined reference air-to-fuel ratio whenever said parameter is within said predetermined range; and means for determining the period of time during which said sensed air-to-fuel exceeds or is less than said predetermined reference value.

32. A system as in claim 31 wherein said range determining means includes at least one of:

means for determining if the temperature of the coolant of said engine is below a predetermined reference value;

means for determining if the temperature of the coolant of said engine is below a predetermined reference value;

means for determining if the speed of said engine is within a predetermined range; and means for determining whether less than a predetermined period of time has elapsed since said engine was last accelerated.

* * * * *